US006450102B2

(12) United States Patent
Theurer et al.

(10) Patent No.: US 6,450,102 B2
(45) Date of Patent: Sep. 17, 2002

(54) BALLAST TAMPING MACHINE, AND MACHINE OF MAINTAINING A TRACK SECTION

(75) Inventors: Josef Theurer, Vienna; Friedrich Peitl, Linz, both of (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 09/774,830

(22) Filed: Jan. 31, 2001

(30) Foreign Application Priority Data

Feb. 29, 2000 (AT) ..... 141/2000 U

(51) Int. Cl.[7] ..... E01B 29/04
(52) U.S. Cl. ..... 104/7.3; 104/12
(58) Field of Search ..... 104/2, 7.1, 7.2, 104/7.3, 12, 10

(56) References Cited

U.S. PATENT DOCUMENTS

| | | | | | |
|---|---|---|---|---|---|
| 5,101,733 | A | * | 4/1992 | Mohr | 104/12 |
| 5,320,045 | A | * | 6/1994 | Theurer | 104/2 |
| 5,452,528 | A | | 9/1995 | Theurer et al. | 104/2 |
| 5,456,180 | A | * | 10/1995 | Theurer et al. | 104/12 |
| 5,456,181 | A | * | 10/1995 | Theurer et al. | 104/2 |
| 5,477,787 | A | * | 12/1995 | Theurer et al. | 104/12 |
| 5,502,904 | A | | 4/1996 | Theurer et al. | 104/2 |
| 5,555,941 | A | * | 9/1996 | Theurer et al. | 104/2 |
| 5,579,593 | A | * | 12/1996 | Murray | 104/2 |
| 5,611,403 | A | | 3/1997 | Theurer et al. | 104/2 |
| 5,660,112 | A | | 8/1997 | Theurer | 104/2 |
| 5,664,633 | A | * | 9/1997 | Theurer et al. | 104/12 |
| 5,709,270 | A | * | 1/1998 | Theurer et al. | 104/2 |

FOREIGN PATENT DOCUMENTS

| | | |
|---|---|---|
| DE | 43 41 240 | 6/1994 |
| EP | 0 436 757 | 12/1992 |
| GB | 2 270 943 | 8/1995 |

* cited by examiner

*Primary Examiner*—S. Joseph Morano
*Assistant Examiner*—Lars A. Olson
(74) *Attorney, Agent, or Firm*—Henry M. Feiereisen

(57) ABSTRACT

A machine for tamping ballast underneath a railroad track includes a machine frame extending in a longitudinal direction and supported on the track by undercarriages for mobility in an operating direction. A tamping unit and a track lifting and lining unit cooperate with one another and are mounted on the machine frame. A suction apparatus is provided for aspirating ballast and includes a suction line connected to a ballast suction nozzle which is associated with the tamping unit. Drives are provided for adjusting the ballast suction nozzle vertically and transversely to the longitudinal direction. A ballast plow is mounted on the machine frame, and a discharge chute is provided for ejecting ballast onto the track. In this manner, short sections of track exhibiting inferior ballast conditions can be ballasted and tamped.

23 Claims, 1 Drawing Sheet

BALLAST TAMPING MACHINE, AND MACHINE OF MAINTAINING A TRACK SECTION

CROSS-REFERENCES TO RELATED APPLICATIONS

This application claims the priority of Austrian Patent Application, Serial No. GM 141/2000, filed Feb. 29, 2000, the subject matter of which is incorporated herein by reference.

BACKGROUND OF THE INVENTION

The present invention relates, in general, to a ballast tamping machine.

This type of a track maintenance machine is provided for tamping ballast underneath a railroad track, and generally includes a machine frame supported on the track by undercarriages for mobility in an operating direction, and a tamping unit and a track lifting and lining unit.

European Patent No. 0 436 757 B1 describes a ballast tamping machine including a tamping unit and provided with a pipeline for transporting ballast and associated with the tamping unit. In this manner, new ballast can be discharged onto the track in the region of the tamping unit. Thus, in track sections where there is a deficiency of ballast, the ballast bed can be filled up, as required, in parallel with the tamping operation.

U.S. Pat. No. 5,611,403 or British Patent No. 2 270 943 B describe track maintenance machines having a suction nozzle for aspirating ballast from the track.

It would be desirable and advantageous to provide an improved ballast tamping machine to realize optimal tamping results even in track sections that exhibit unserviceable ballast conditions.

SUMMARY OF THE INVENTION

The present invention provides for a machine for tamping ballast underneath a railroad track, which comprises a machine frame extending in a longitudinal direction and supported on the track by undercarriages for mobility in an operating direction. A tamping unit is mounted on the machine frame, and a track lifting and lining unit cooperates with the tamping unit. A suction apparatus for aspirating ballast is provided on the machine frame and includes a suction line connected to a ballast suction nozzle which is associated with the tamping unit. Drives are provided for adjusting the ballast suction nozzle vertically and transversely to the longitudinal direction. A ballast plow is mounted on the machine frame, and a discharge chute is provided for ejecting ballast onto the track.

This special combination of working devices makes it possible in an advantageous way to remove and replace ballast which is unfit for use in tamping operations or for attaining durable tamping results. Unusable ballast can be substituted immediately prior to the tamping procedure. The new ballast can be distributed evenly across the track by means of the ballast plow and can subsequently be compacted immediately with the aid of the tamping unit in order to create a durable and permanent track position. Advantageously, the tamping machine can be employed without any restriction whatsoever also for operation in normal track sections where the prevailing ballast conditions are satisfactory.

According to another feature of the present invention, the discharge chute is positioned between the ballast suction nozzle and the ballast plow. According to yet another aspect, ballast hoppers are mounted on the machine frame, and a longitudinal conveyor belt extending in the longitudinal direction is arranged partly underneath the ballast hoppers and has an ejection end associated with the discharge chute.

According to another feature of the present invention, a transverse conveyor belt is mounted on the machine frame and extends perpendicular to the longitudinal direction, with the longitudinal conveyor belt including a second end, distanced from the ejection end, which is arranged above the transverse conveyor belt. A second discharge chute having a receiving opening may be provided above the transverse conveyor belt, and the suction line may comprise a discharge opening emptying into the receiving opening.

According to another feature of the present invention, at least two ballast hoppers may be provided, one following the other in the longitudinal direction, with each ballast hopper being associated with a respective closeable discharge opening of the suction line for filling the hopper.

BRIEF DESCRIPTION OF THE DRAWING

The above and other objects, features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
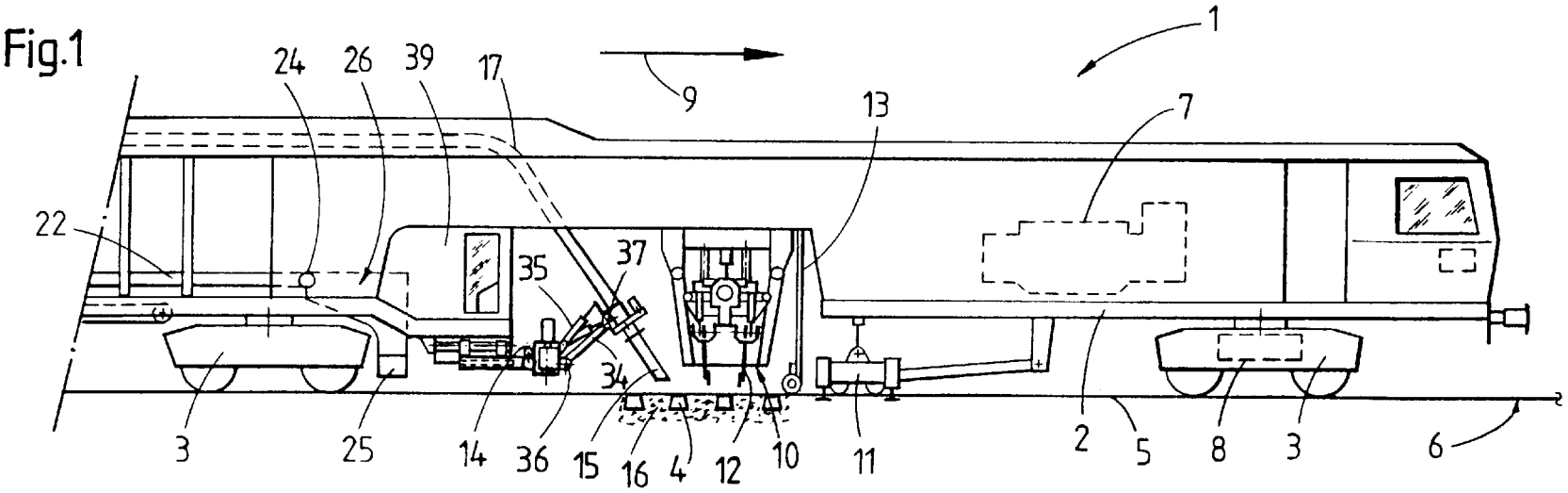
FIG. 1 is a side elevational view of a front half of a ballast tamping machine according to the present invention.

Throughout all the Figures, same or corresponding elements are generally indicated by same reference numerals.

Figure 2:
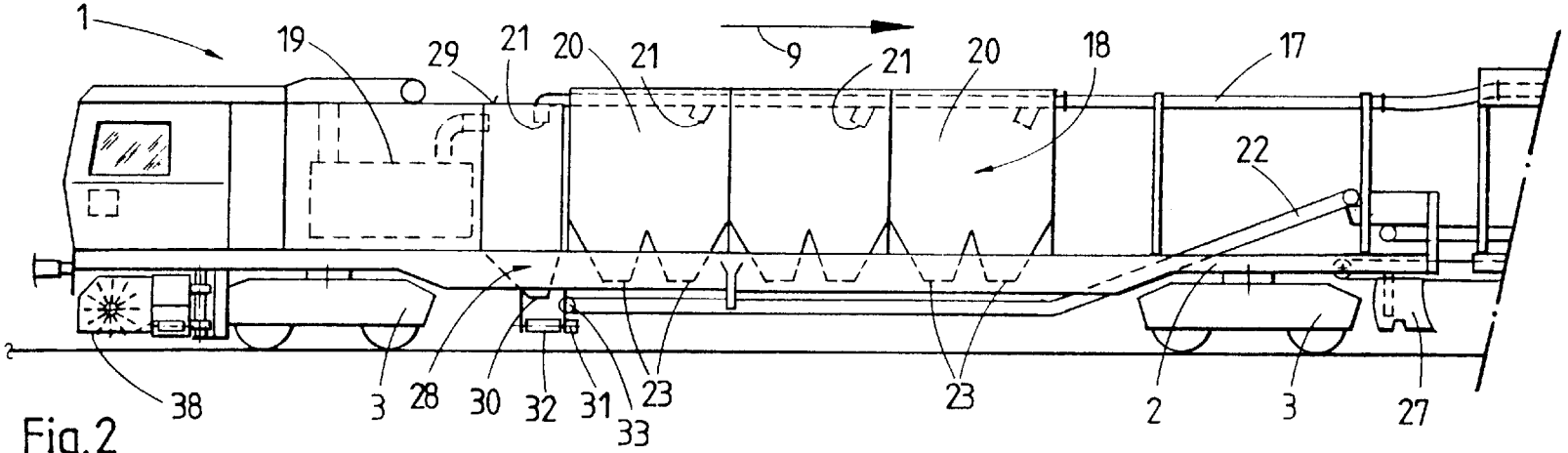
FIG. 2 is a side elevational view of a rear half of the ballast tamping machine of FIG. 1.

Referring now to FIGS. 1 and 2, there are shown side elevations of the front and rear halves of a tamping machine 1 for tamping ballast 16 under a railroad track 6 comprising two rails 5 fastened to ties 4. The tamping machine 1 includes a two-part elongate machine frame 2 whose parts are linked together and which is supported on the track 6 by undercarriages 3. A motor 7 and a motive drive 8 are provided for advancing the tamping machine 1 along the track 6 in an operating direction indicated by arrow 9.

A tamping unit 10, adjustable by means of drives both vertically and transversely to the longitudinal direction, and a track lifting and lining unit 11 are positioned between the two forwardly located undercarriages 3, as viewed in the operating direction. The tamping unit 10 typically includes tamping tines 12 squeezable in the longitudinal direction by means of drives. A track position control system 13, shown only in part here, is provided for checking the position of the track 6.

Located immediately behind the tamping unit 10, with regard to the operating direction of the tamping machine 1, is a ballast suction nozzle 15 which is adjustable by drives 14 in directions vertically and transversely to the longitudinal extension of the machine 1 for aspirating ballast 16 of the track 6. The suction nozzle 15 is connected to a suction apparatus 18 by means of a suction line 17 which runs in the longitudinal extension of the machine 1. The suction apparatus 18 is mounted on the machine frame 2 and essentially includes of a vacuum pump 19, three ballast hoppers 20, which are arranged in series behind one other in the longitudinal direction, as well as filter chambers which are not explicitly shown in the drawing. Of course, the arrangement of three ballast hoppers 20 is made by way of example only, and it will be appreciated that the number of ballast hoppers may vary depending on the need and situation at hand.

The suction line 17 includes a same number of discharge openings 21 as the number of ballast hoppers 20 so as to provide a communication of the suction line 17 with each of the ballast hoppers 20. Although not shown in detail, each of the discharge openings 21 enters the ballast hoppers 20 at the top thereof and has a closure mechanism which is actuatable by remote control for opening and closing the discharge openings 21. Thus, the ballast hoppers 20 can be selectively filled. Each of the ballast hoppers 20 has a lower end region formed with an outlet opening 23 which is also provided with a remote-controlled closure mechanism for opening and closing the outlet opening 23. An exemplified construction and manner of operation of a typical closure mechanism for use with the discharge openings 21 and outlet openings 23 is fully described in U.S. Pat. No. 5,502,904, to which reference is made herewith. The outlets openings 23 are positioned above a conveyor belt 22 which extends in the longitudinal direction of the machine 1 and runs partly underneath the ballast hoppers 20. The conveyor belt 22 has a forward ejection end 24 which is positioned above a discharge chute 26 for ejecting ballast via outlet openings 25 that lead to the track 6. Positioned in the operating direction behind the discharge chute 26 is a ballast plow 27 which is connected to the machine frame 2 and configured for vertical adjustment by means of drives (not shown).

Disposed in the operating direction immediately behind the suction apparatus 18 is a second discharge chute 28 having a receiving opening 29 and closeable outlet openings 30. The outlet openings 30 are located above a transverse conveyor belt 32 which is mounted to the machine frame 2 and runs perpendicular to the longitudinal extension of the machine 1. The conveyor belt 32 is operated by a drive 31 and is so configured that a part thereof is positioned underneath a second conveyor belt end 33, distanced from the ejection end 24, of the conveyor belt 22. A further, optionally closeable, discharge opening 21 of the suction line 17 enters through the receiving opening 29 of the second discharge chute 28.

The ballast suction nozzle 15, mounted transversely and vertically adjustably on the machine frame 2, is fastened to a nozzle suspension 34 which is swingable by means of a drive 35 about a horizontal swivel axle 36 extending perpendicular to the longitudinal extension of the machine 1. In addition to the support on the swivel axle 36, the suction nozzle 15 is additionally supported on a second horizontal axle 37, which extends perpendicular to the longitudinal extension of the machine 1, for pivoting by means of a drive 35.

The operation of the above-described tamping machine 1 will now be described in more detail:

The tamping machine 1 is particularly suited for application in track sections in which short portions of about six to ten sleeper divisions in length exhibit ballast conditions which are no longer acceptable to guarantee durable tamping results. As soon as such a track section is reached, the ballast suction nozzle 15 is lowered and immersed between the ties 4 and, by creating a vacuum, spoiled ballast 16 is aspirated and, for example, stored in an empty one of the ballast hoppers 20. Optionally, the track 6 may be elevated by the track lifting and lining unit 11 during ballast withdrawal. As the machine 1 is advanced step-by-step, the following cribs are successively emptied until the soiled ballast 16 of the entire track section to be renewed has been suctioned off and stored. Already during subsequent return travel of the machine 1, new ballast stored in the other two of the ballast hoppers 20 is discharged onto the conveyor belt 22 via the associated outlet openings 23 and transported by the conveyor belt 22 to the discharge chute 26 for subsequent ejection of new ballast onto the track 6 and distributed over the track profile.

During a subsequent forward travel by the machine 1 in the operating direction (arrow 9), the ballast plow 27 is lowered to distribute the discharged new ballast 16 evenly across the entire width of the track 6. Thereafter, the renewed track section is brought into the correct, desired position by the tamping unit 10, the track lifting and lining unit 11 and the track position control system 13.

Through arrangement of several ballast hoppers 20 with a subjacent conveyor belt 22 as well as provision of the rear, second discharge chute 28 and the transverse conveyor belt 32, the machine 1 can be suited to ballast conditions at hand. For example, in the event a lack of storage capacity bars a storage of spoiled ballast, the suction line 17 can be used to empty the excess spoiled ballast into the second discharge chute 28. Optionally, the second discharge chute 28 may also be used for additional storage, whereby in this case the outlet openings 30 are then closed. As an alternative, it is also possible at any time to unload soiled ballast 16 from the second discharge chute 28 via the transverse conveyor belt 32 to one of the two ballast bed shoulders of the track 6. Likewise, it is possible to empty a ballast hopper 20 that has been filled with soiled ballast 16 by discharging ballast through the outlet openings 23 onto the longitudinal conveyor belt 22 for transfer to the transverse conveyor belt 32. Of course, it is also possible in the event of increased storage demand to fill a second one of the ballast hoppers 20 with soiled ballast, as soon as cleaned ballast previously stored therein has been discharged completely onto the track 6.

Suitably, the machine 1 further includes a sweeping brush 38 which is arranged at the rear end of the machine frame 2 to sweep the track 6 in a final step, preferably in connection with the track tamping operation. An operator's cab 39 is so located that the operator has very good visibility of the ballast suction nozzle 15 and the tamping unit 10.

While the invention has been illustrated and described as embodied in a ballast tamping machine, and method of maintaining a track section, it is not intended to be limited to the details shown since various modifications and structural changes may be made without departing in any way from the spirit of the present invention.

What is claimed as new and desired to be protected by Letters Patent is set forth in the appended claims:

1. A machine for tamping ballast underneath a railroad track, comprising a machine frame extending in a longitudinal direction and supported on the track by undercarriages for mobility in an operating direction;

a tamping unit mounted on the machine frame;

a track lifting and lining unit cooperating with the tamping unit;

a suction apparatus for aspirating ballast, said suction apparatus comprising a suction line connected to a ballast suction nozzle, said ballast suction nozzle being associated with the tamping unit;

drives for adjusting the ballast suction nozzle vertically and transversely to the longitudinal direction;

a ballast plow mounted on the machine frame; and a discharge chute provided for ejecting ballast onto the track.

2. The tamping machine of claim 1, wherein the discharge chute is positioned between the ballast suction nozzle and the ballast plow.

3. The tamping machine of claim 1, and further comprising ballast hoppers mounted on the machine frame, and a longitudinal conveyor belt extending in the longitudinal direction and arranged partly underneath the ballast hoppers, said longitudinal conveyor belt having an ejection end associated with the discharge chute.

4. The tamping machine of claim 3, and further comprising a transverse conveyor belt mounted on the machine frame and extending perpendicular to the longitudinal direction, said longitudinal conveyor belt comprising a second end which is distanced from the ejection end above the discharge chute, said second end of the longitudinal conveyor belt being arranged above the transverse conveyor belt.

5. The tamping machine of claim 4, and further comprising a second discharge chute provided above the transverse conveyor belt and having a receiving opening, said suction line including a discharge opening communicating with the receiving opening.

6. The tamping machine of claim 3, wherein at least two of said ballast hoppers are provided, one following the other in the longitudinal direction, each said ballast hopper being associated with a closeable discharge opening of the suction line for filling the ballast hopper.

7. The tamping machine of claim 3, wherein each said ballast hopper further includes a closeable outlet opening arranged above the longitudinal conveyor belt.

8. The tamping machine of claim 1, wherein the ballast suction nozzle, the discharge chute and the ballast plow are arranged behind the tamping unit in the operating direction.

9. The tamping machine of claim 1, and further comprising a nozzle suspension connected to the ballast suction nozzle, said nozzle suspension being configured for pivoting about a horizontal swivel axis which extends perpendicular to the longitudinal direction.

10. The tamping machine of claim 9, wherein the ballast suction nozzle, in addition to being mounted on the swivel axis, is swingably mounted on a horizontal axle extending perpendicular to the longitudinal direction, and further comprising drives for pivoting the ballast suction nozzle about the horizontal axle.

11. A ballast tamping machine, comprising a track-bound machine frame defining a longitudinal axis and traveling in an operating direction;

a tamping unit mounted on the machine frame;

a suction apparatus having a suction nozzle which is positioned in proximity of the tamping unit for withdrawing old ballast from a track section, and a first drive for adjusting the suction nozzle in directions vertical and transverse to the longitudinal axis;

a first discharge chute provided for ejecting new ballast onto the track; and a ballast plow mounted on the machine frame for distributing ballast on the track.

12. The tamping machine of claim 11, wherein the first discharge chute is positioned between the suction nozzle and the ballast plow.

13. The tamping machine of claim 11, wherein the suction apparatus includes a hopper arrangement mounted on the machine frame, and a first conveyor belt extending in the direction of the longitudinal axis and arranged partly underneath the hopper arrangement, said first conveyor belt having opposite ends, with one of the ends positioned adjacent the first discharge chute.

14. The tamping machine of claim 13, wherein the suction apparatus includes a second conveyor belt mounted on the machine frame and extending perpendicular to the longitudinal axis, said other one of the ends of the first conveyor arranged above the second conveyor belt.

15. The tamping machine of claim 14, and further comprising a second discharge chute disposed above the second conveyor belt and having a receiving opening, said suction apparatus including a suction line which terminates in the suction nozzle and includes a discharge opening in communication with the receiving opening.

16. The tamping machine of claim 13, wherein the hopper arrangement includes at least two hoppers arranged in series behind one another in the direction of the longitudinal axis, said suction apparatus including a suction line which terminates in the suction nozzle and includes at least two discharge openings for filling the hoppers with ballast, each of the discharge openings communicating with a corresponding one of the hoppers, whereby the discharge openings and the hoppers are placed into one-to-one correspondence.

17. The tamping machine of claim 16, wherein the hopper arrangement includes means for closing the discharge openings of the hoppers.

18. The tamping machine of claim 16, wherein each of the hoppers of the hopper arrangement has an outlet opening arranged above the first conveyor belt.

19. The tamping machine of claim 18, wherein the hopper arrangement includes means for closing the outlet opening of each of the hoppers.

20. The tamping machine of claim 12, wherein the suction nozzle, the first discharge chute and the ballast plow are arranged in the operating direction behind the tamping unit.

21. The tamping machine of claim 11, wherein the suction apparatus includes a suspension for support of the suction nozzle, said suspension being swingably mounted for rotation about a horizontal first swivel axis which extends perpendicular to the longitudinal axis.

22. The tamping machine of claim 21, wherein the suction apparatus includes a second drive for rotation of the suction nozzle about a horizontal second swivel axis which extends perpendicular to the longitudinal axis.

23. A track maintenance machine, comprising:

a machine frame defined by an axis;

first means, mounted to the machine frame, for tamping ballast underneath a track section;

second means, mounted to the machine frame for withdrawal of old ballast from the track section, said second means having a suction nozzle and a drive mechanism for adjusting the suction nozzle in a direction vertical and transverse to the axis;

third means, mounted to the machine frame, for supplying new ballast to the track section and distributing new ballast across the track section wherein the second means is positioned in proximity of the first means and so coordinated with the first and third means as to allow rapid replacement of old ballast and tamping of new ballast.

* * * * *